US010141672B2

(12) United States Patent
Griepenstroh

(10) Patent No.: US 10,141,672 B2
(45) Date of Patent: Nov. 27, 2018

(54) LATCHING MEANS FOR PLUG CONTACTS

(71) Applicant: HARTING Electric GmbH & Co. KG, Espelkamp (DE)

(72) Inventor: Sebastian Griepenstroh, Lübbecke (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/553,099

(22) PCT Filed: Feb. 1, 2016

(86) PCT No.: PCT/DE2016/100042

§ 371 (c)(1),
(2) Date: Aug. 23, 2017

(87) PCT Pub. No.: WO2016/134694

PCT Pub. Date: Sep. 1, 2016

(65) Prior Publication Data

US 2018/0034186 A1 Feb. 1, 2018

(30) Foreign Application Priority Data

Feb. 25, 2015 (DE) ..... 10 2015 102 662

(51) Int. Cl.
*H01R 13/40* (2006.01)
*H01R 13/422* (2006.01)
*H01R 13/506* (2006.01)

(52) U.S. Cl.
CPC ..... *H01R 13/4223* (2013.01); *H01R 13/506* (2013.01)

(58) Field of Classification Search
CPC ..... H01R 13/4223; H01R 13/4365; H01R 13/6215; H01R 13/514
USPC ..... 439/752.5, 595, 362–364, 594, 598, 733
See application file for complete search history.

(56) References Cited

U.S. PATENT DOCUMENTS 5,672,075 A 9/1997 Maejima
5,879,192 A 3/1999 Machida et al.
7,407,613 B2 8/2008 Ferderer
(Continued)

FOREIGN PATENT DOCUMENTS

DE 31 20 040 A1 12/1982
DE 10 2006 004 782 B4 5/2011
DE 10 2009 053 778 A1 6/2011
(Continued)

OTHER PUBLICATIONS

German Office Action, dated May 31, 2017, for German Application No. 10 2015 102 662.7, 5 pages.
(Continued)

*Primary Examiner* — Phuong Chi T Nguyen
(74) *Attorney, Agent, or Firm* — Seed IP Law Group LLP

(57) ABSTRACT

A latching mechanism for plug contacts in insulating housings of plug connectors is provided. The latching mechanism which, in addition to the known arrangement of a latching arm and latching shoulder, provides a latching lug on the latching shoulder. As a result of the latching lug, the latching mechanism is prevented from becoming released under a mechanical load. The latching lug enables additional latching of the latching arm against the plug contact.

6 Claims, 2 Drawing Sheets

(56) References Cited

U.S. PATENT DOCUMENTS

| | | | | |
|---|---|---|---|---|
| 8,083,543 | B2 * | 12/2011 | Omori | H01R 31/08<br>439/511 |
| 2013/0109210 | A1 | 5/2013 | Zhang | |

FOREIGN PATENT DOCUMENTS

| | | | |
|---|---|---|---|
| DE | 10 2011 087 243 | B3 | 3/2013 |
| EP | 0 732 775 | A2 | 9/1996 |
| EP | 1 339 138 | A1 | 8/2003 |
| RU | 2 256 986 | C2 | 7/2005 |
| WO | 2013/079358 | A1 | 6/2013 |

OTHER PUBLICATIONS

International Search Report and Written Opinion, dated May 2, 2016, for International Application No. PCT/DE2016/100042, 13 pages. (with English Translation of Search Report).
Russian Office Action, dated Jun. 27, 2018, for Russian Application No. 2017132979/07(058037), 7 pages.
International Preliminary Report on Patentability, dated Jun. 12, 2017, for International Application No. PCT/DE2016/100042, 28 pages. (with English Translation).

* cited by examiner

LATCHING MEANS FOR PLUG CONTACTS

BACKGROUND

Technical Field

This disclosure relates to a latching mechanism for plug contacts.

Description of the Related Art

Latching mechanisms are known for latching plug contacts in insulating bodies of plug connectors and for securing them therein. By latching the contacts, further fastening of the plug contacts in the insulating body is no longer necessary. Automatic latching of this type saves time and money during assembly, which can be undertaken without the aid of tools.

DE 10 2006 004 782 B4 discloses an insulating body of this type for receiving plug contacts. In this, latching arms having latching shoulders are produced by means of two mutually engaging molded cores. The latching shoulders of the latching arms project into the insulating body such that an inserted plug contact latches behind them.

DE10 2009 053 778 A1 presents an electrical plug connector which is formed to be plugged together with a complementary plug connector and has corresponding latching members for this.

DE 10 2011 087 243 B3 presents an electrical plug connector which has a contact securing means. The contact securing means here has at least one elastic contact lance which latches in the interior of the plug connector.

Latching mechanisms of this type are disadvantageous in that the latching shoulder is only held in position for the latching of the plug contact by the spring force of the latching arm. For dismantling purposes, for example, as a result of deflecting the latching arm by means of a tool, the latching shoulder can release the plug contact and the latter can be removed.

However, a deflection of the latching arm can be effected not only by a tool, but also under the influence of an increased force on the plug contact itself. If this acts on the latching shoulder and a rotation occurs at the same time, the resultant force generates a deflection of the latching arm and therefore releases the plug contact unintentionally.

BRIEF SUMMARY

Embodiments of the present invention provide a latching mechanism for plug contacts that eliminate at least some of the disadvantages known from the prior art and which enables plug contacts to remain reliably latched under the forces and moments which occur.

Embodiments of the invention relate to a latching mechanism for plug contacts of plug connectors. The latching mechanism is received in an insulating housing in which the plug contacts can be inserted. The housing has at least one contact opening which serves to receive a plug contact. Depending on the type of plug connector, the insulating housing forms the plug connector housing directly or is in turn received in a plug connector housing.

The latching mechanism is formed by at least one latching arm, which projects into the at least one contact opening of the housing. The latching arm may be advantageously produced in one piece with the insulating body. The latching arm here has a fixed end with which it is fastened in the contact opening. The second end of the latching arm forms a free end which is movable against the spring stiffness of the latching arm.

A latching shoulder is provided at the free end of the latching arm. The latching shoulder is aligned at an approximate right angle to the latching arm and projects into the contact opening such that an inserted plug contact can latch behind it. The plug contact preferably latches by means of a cable-connection side behind the latching shoulder. To this end, the plug contact is guided completely past the latching shoulder as it is inserted into the contact opening. As a result of an insertion chamfer on the latching shoulder, this latter is pushed away laterally in opposition to the spring force of the latching arm by the plug contact. Behind the plug contact, the latching shoulder latches behind the plug contact again as a result of the spring force of the latching arm and secures this plug contact against being pulled out.

According to an embodiment of the invention, an additional latching lug is formed on the latching shoulder. This latching lug is aligned in the direction of the fixed end of the latching arm. The latching lug is designed such that it engages in a cable receiving opening of the plug contact. The latching arm, the latching shoulder and the latching lug thereby together surround at least one region of the cable receiving opening of the plug contact.

As a result of this expedient arrangement, it is only possible to deflect the latching arm when the plug contact is not touching the latching shoulder. In this case, the latching lug would prevent a deflection of the latching arm. The plug contact is located in a pocket which is formed by the latching arm, the latching shoulder and the latching lug. It is only through the brief further insertion of the plug contact into the contact opening that the plug contact releases the latching lug and an opening of the latching mechanism is possible.

Embodiments of the present invention solve the problem posed at the outset in that, as a result of a latching arm, which can only be deflected and release a plug contact when the plug contact does not exert a force on the latching shoulder. Instead, the deflection of the latching arm becomes more difficult as the force effect on the latching shoulder increases.

BRIEF DESCRIPTION OF THE SEVERAL VIEWS OF THE DRAWINGS

An exemplary embodiment of the invention is illustrated in the drawings and explained in more detail below. In the drawings.

DETAILED DESCRIPTION

Figure 1:
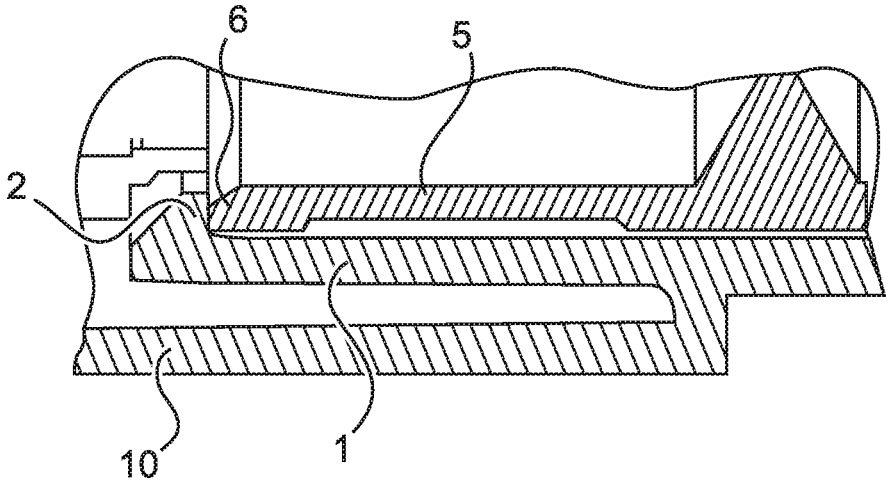
FIG. 1 shows a cross-sectional view of a conventional latching mechanism for plug contacts.

The figures contain partially simplified schematic illustrations. Identical reference numerals are sometimes used for elements which are similar, but maybe not identical. Different views of the same elements could be shown on a different scale.

FIG. 1 shows a detail of a sectional illustration through a plug connector, having a latching mechanism for a plug contact 5 as known from the prior art. The insulating housing 10 of the plug connector forms a contact opening (upper region of the figure) into which the plug contact 5 is inserted.

A resilient latching arm 1 is furthermore formed in one piece on the insulating housing 10. The latching arm 1 is designed to be resilient so that a free end of the latching arm 1 is movable relative to a fixed end. The free end of the latching arm 1 is provided with a latching shoulder 2. The latching shoulder 2 projects into the contact opening, linearly flush with the deflection direction of the free end of the contact arm 1.

The received plug contact 5 latches by means of a cable-receiving side 6 behind the latching shoulder 2. A pulling out of the plug contact in the direction of the latching shoulder 2 is only possible through a deflection of the entire latching arm 1.

Figure 2:
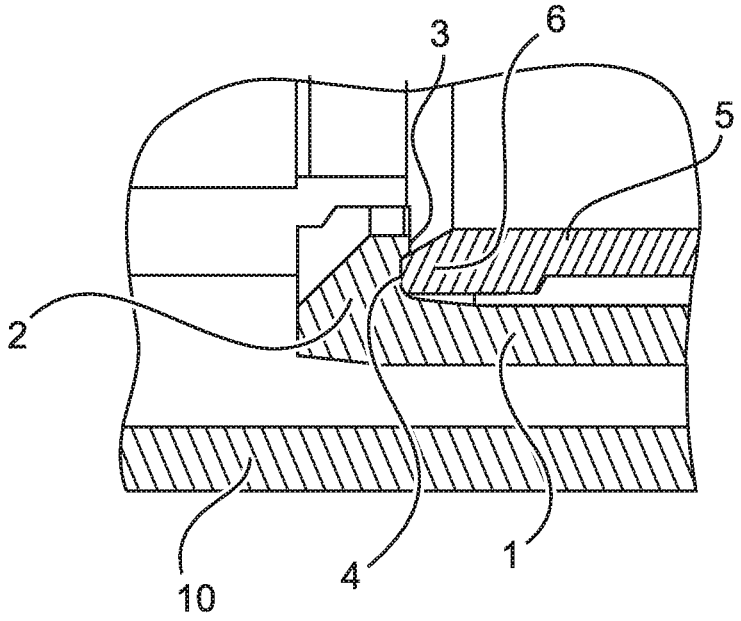
FIG. 2 shows a cross-sectional view of a latching mechanism for plug contacts according to an example embodiment of the present invention.

A latching mechanism for a plug contact 5 according to an example embodiment of the present invention is illustrated in FIG. 2 in a similar sectional view as in FIG. 1. The embodiment corresponds for the most part to that of FIG. 1. According to the example embodiment of the present invention shown in FIG. 2, a latching lug 3 is provided on the latching shoulder 2. The latching lug 3 is aligned along the latching arm 1 in the direction of the fixed end thereof.

As a result of the alignment of the latching lug 3, this forms a groove 4 together with the latching shoulder 2 and the latching arm 1. As can be seen in FIG. 2, the end of the cable-receiving side 6 of the plug contact 5 is received in the groove 4. A deflection of the latching arm 1 is now impossible as a result of the latching lug 3.

The latching lug 3 prevents a deflection by engaging in the cable-receiving side 6 of the plug contact. To enable a deflection and therefore the release of the plug contact 5, this firstly has to be pushed further into the contact opening of the insulating housing 10 until the latching lug 3 is released.

Figure 3:
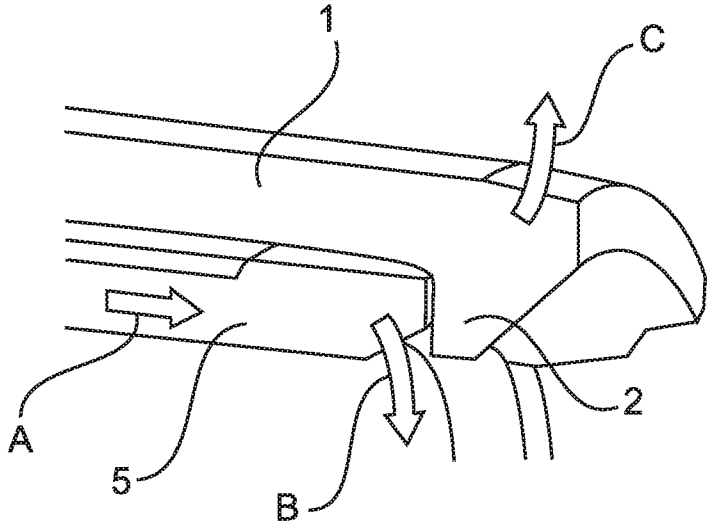
FIG. 3 shows a three-dimensional illustration of the conventional latching mechanism for plug contacts.

The latching mechanism according to FIG. 1, which is known from the prior art, is illustrated again in FIG. 3 in a three-dimensional detail view. The disadvantages of this solution are shown here. As a result of two forces being introduced onto the plug contact 5, this can be freed from the latching mechanism.

If the plug contact 5 is pushed in the direction of the latching shoulder 2 by means of a force A, a radial force C is exerted on the latching shoulder 2 and latching arm 1 as a result of the force from the plug contact 5 on the latching shoulder 2. However, owing to the friction between the plug contact 5 and the latching shoulder 2, this force C is not great enough to deflect the latching arm 1. However, if a rotational movement of the contact 5 is additionally generated by a moment B, the dynamic friction between the plug contact 5 and the latching shoulder 2 is considerably lower and the latching arm 1 is deflected by the force C. The latching mechanism can be freed as a result of this force C and the plug contact 5 can be released unintentionally.

Figure 4:
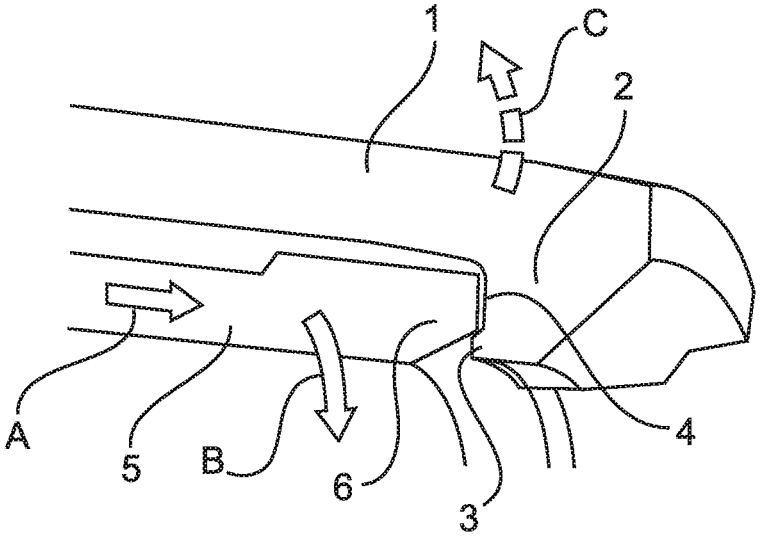
FIG. 4 shows a three-dimensional illustration of the latching mechanism for plug contacts according to the example embodiment of the present invention shown in FIG. 2.

This unintentional effect is prevented by the solution according to embodiments of the prevent invention. This is illustrated again accordingly in FIG. 4. A force C is likewise generated by the force A in conjunction with the moment B. However, this force C is absorbed by the latching lug 3 of the example embodiment shown in FIG. 4. The latching lug 3 therefore latches the latching arm 1 against the plug contact 5. The latching of the plug contact 5 is therefore prevented from being freed unintentionally.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A latching mechanism for plug contacts, comprising at least one latching arm arranged in an insulating housing, wherein the latching arm has a fixed end and a free end, wherein the insulating housing has a contact receiving opening within which to receive a plug contact in an insertion direction, wherein the latching arm forms a latching shoulder at the free end, the latching shoulder extending approximately perpendicularly to the insertion direction and projecting into the contact receiving opening to latch behind a latch receiving portion of the plug contact upon insertion of the plug contact into the contact receiving opening, and wherein a latching lug is formed on the latching shoulder at the free end of the latching arm and extends from the latching shoulder in a direction toward the fixed end of the latching arm in order to hook around the latch receiving portion of the plug contact and to prevent the latching arm from being displaced away from the contact receiving opening while the latching shoulder is in contact with the latch receiving portion of the plug contact.

2. The latching mechanism for plug contacts as claimed in claim 1, wherein the latching arm is aligned approximately parallel to the insertion direction and the latching shoulder is aligned approximately perpendicularly to the latching arm.

3. The latching mechanism for plug contacts as claimed in claim 1, wherein the latching arm together with the latching shoulder and the latching lug form a groove that opens in the insertion direction and is configured to receive the latch receiving portion of the plug contact.

4. The latching mechanism for plug contacts as claimed in claim 1, wherein the latching arm, the latching shoulder and the latching lug together are configured to surround the latch receiving portion of the plug contact when the plug contact is received in the insulating housing.

5. The latching mechanism for plug contacts as claimed in claim 1, wherein the latching arm is formed to be resilient so that the free end is movable relative to the fixed end.

6. An insulating housing for plug contacts, comprising:

an insulating housing body having a contact receiving opening within which to receive a plug contact in an insertion direction; and a latching mechanism including at least one latching arm that extends from the insulating housing body approximately parallel to the insertion direction and has a fixed end and a free end, wherein the latching arm includes a latching shoulder at the free end, the latching shoulder extending approximately perpendicularly to the insertion direction and projecting into the contact receiving opening of the insulating housing body to latch behind a latch receiving portion of the plug contact upon insertion of the plug contact into the contact receiving opening, and wherein a latching lug is formed on the latching shoulder at the free end of the latching arm and extends from the latching shoulder in a direction toward the fixed end of the latching arm in order to cup around the latch receiving portion of the plug contact and to prevent the latching arm from being displaced away from the contact receiving opening while the latching shoulder is in contact with the latch receiving portion of the plug contact.

* * * * *